United States Patent [19]

Bourbonnais et al.

[11] Patent Number: 4,727,366

[45] Date of Patent: Feb. 23, 1988

[54] APPARATUS AND METHOD FOR CRT DISPLAY SCREEN

[75] Inventors: Jean Bourbonnais, Town of Mount Royal; Serge Froment, Rosemère; Pierre Cadieux, Montreal, all of Canada

[73] Assignee: Arabic Latin Information Systems Inc., St. Laurent, Canada

[21] Appl. No.: 761,687

[22] Filed: Aug. 2, 1985

[51] Int. Cl.[4] ..... G09G 1/16

[52] U.S. Cl. ..... 340/748; 340/750; 340/792; 400/109

[58] Field of Search ..... 400/109, 110, 111, 323.1; 340/709, 706, 723, 724, 748, 750, 792

[56] References Cited

U.S. PATENT DOCUMENTS 4,205,310 5/1980 McMann, Jr. et al. ..... 340/750
4,507,734 3/1985 Kaldas ..... 400/111

OTHER PUBLICATIONS

"Writing Orientation for a Display Terminal", *IBM Technical Disclosure Bulletin,* vol. 28, No. 2, Jul. 1985, p. 746.

Batey, M. A. et al., "Dual Direction Keying Display", *IBM Technical Disclosure Bulletin,* vol. 22, No. 1, Jun. 1979, pp. 376–388.

Johnson, C. F., et al., "Modified 'Mixed Text' Function for an Electronic Typewriter", *IBM Technical Disclosure Bulletin,* vol. 24, No. 4, Sep. 1981, pp. 1829–1836.

Warnecke, C. G., "Mixed Left-Right, Right-Left Display", *IBM Technical Disclosure Bulletin,* vol. 24, No. 8, Jan. 1982, pp. 4305–4307.

*Primary Examiner*—Gerald L. Brigance
*Attorney, Agent, or Firm*—Fishman & Dionne

[57] ABSTRACT

The video memory of a CRT display system is split into an application video memory and a CRT memory. The two memories are interconnected by logic means for manipulating primary and secondary texts whose characters proceed in directions which are different from each other. The character codes are applied to the application video memory. The logic manipulates the code in accordance with the rules of the primary and secondary languages and provides data to the CRT video memory for driving a CRT controller.

7 Claims, 3 Drawing Figures

APPARATUS AND METHOD FOR CRT DISPLAY SCREEN

BACKGROUND OF THE INVENTION

1. Field of the Invention

The invention relates to a method and apparatus which permits the insertion of text of two languages whose characters proceed in two opposite directions on a CRT display screen. More specifically, the invention relates to such a method and apparatus which is transparent to higher level software, specifically, the operative systems and application programs.

2. Description of Prior Art

At times, when applying a primary text, of a primary language, whose characters proceed in a primary direction (e.g., a Latin text which proceeds from left to right) on a CRT display screen, it may be necessary to make an insertion of a secondary text of a secondary language whose characters proceed in a secondary, different direction (e.g., an Arabic text whose characters proceed from right to left or Japanese which is vertical). Under present methods, and with the present apparatus, the procedures for processing and handling the secondary language must be included as steps in the operating system or the application software. Thus, each time a different operating system or application program is used which requires such insertion, the steps for handling of the secondary language must be included in that different operating system or application program. It is therefore clear that the present apparatus and method do not include a single piece of either hardware or software which is portable, i.e., will automatically be applied as appropriate to any operating system or application software without requiring additional specific program steps. This is, of course, inconvenient in that the procedures must be written into each operating system or application program.

SUMMARY OF THE INVENTION

It is therefore an object of the invention to provide a method and apparatus which permits the insertion of a primary text and a secondary text whose characters proceed in primary and secondary directions which are different from each other, on a CRT display screen.

It is a more specific object of the invention to provide such a method and apparatus which is transparent to higher level software.

In accordance with the invention, the video memory of a CRT display system is split into an application video memory and a CRT video memory. The two memories are interconnected by logic means for manipulating the primary and secondary texts.

In accordance with the method, the character codes are applied to the application video memory. The logic manipulates the codes in accordance with the rules of the primary and secondary languages and provides data to the CRT video memory for driving the CRT controller to permit such insertion.

BRIEF DESCRIPTION OF THE DRAWINGS

The invention will be better understood by an examination of the following description, together with the accompanying drawings, in which.

BRIEF DESCRIPTION OF DRAWINGS

Figure 1:
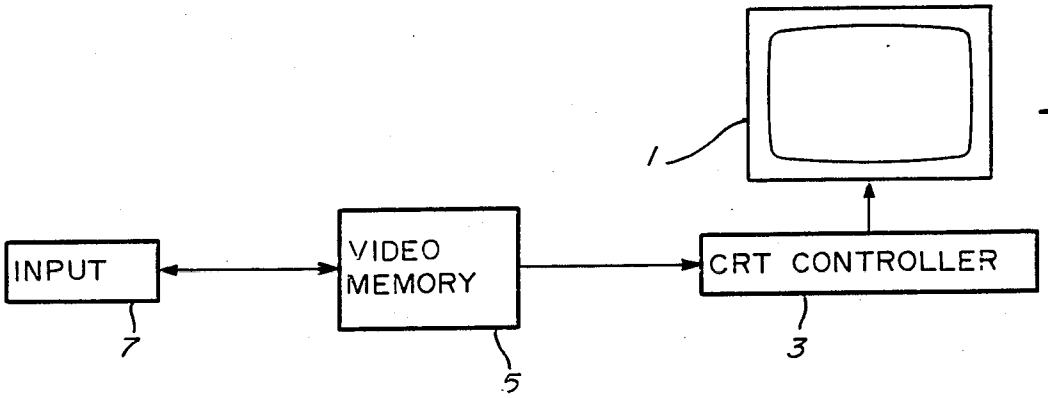
FIG. 1 PRIOR ART
FIG. 1 illustrates a typical prior art system in block form.

Referring to FIG. 1, a presently available system comprises a CRT display screen 1 for displaying a written message comprising characters of the texts of appropriate languages. The characters will be displayed when the screen is given the appropriate control signals from the CRT controller 3. The CRT controller 3 is fed from the video memory 5, which is in turn fed from the character or display code input 7, for example, an application program.

Input means 7 places a character or display code in a specific memory area of the video memory 5. The means 7 are driven from programs and they can also retrieve the codes placed in the video memory 5 if required.

The video memory 5 is really an area of a larger memory and is designed to contain the information which will be displayed on the CRT display screen. The information is stored in video memory 5 by the programs of the means 7 and is available to the CRT controller 3.

The video memory 5 is always organized so that there is a linear (constant or geographically consistant) relationship between its memory cell numbers and the corresponding locations on the screen. Thus, if the video memory cell No. 0 corresponds to the leftmost uppermost location of the screen, and if the cell No. 1 corresponds to the location immediately to the right of the 0 location, and cell No. 2 corresponds to the location to the right of cell No. 1, then the information in cell 0, as above-mentioned, will be displayed in the left-most uppermost location on the screen, and the information in cell No. 1 will be displayed in the space immediately to the right of the previous information, and the information in cell No. 2 will be displayed in the space on the screen to the right of the information displayed for cell 1.

This has significance in that, in presently available methods, the secondary language is inserted into the CRT display Screen by sliding all of the displayed characters one space over in the primary direction and inserting the next character in the recently vacated space. This is illustrated below wherein the primary language is Latin (English) and the secondary language is Arabic:

| Key entered | Display | Comment |
|---|---|---|
| | — | Screen lines and keyboard mode = LATIN. Cursor is a blinking underline on the left side of the screen. |
| H | H_ | |
| e | He_ | |
| l | Hel_ | |
| l | Hell_ | |
| o | Hello_ | |
| <Space> | Hello_ | |
| <Alt><Arabic> | Hello ■ | Keyboard mode = ARABIC (Arabic insertion in Latin text, cursor changes to a blinking block.) |
| ا | ا ■ | |
| ه | | |
| ل | Hello ه ا ■ | Arabic characters slide. |
| | Hello لها ا ■ | |
| | Hello ل ا ل | |

-continued

| Key entered | Display | Comment |
|---|---|---|
| <Alt><Latin> | Hello | Keyboard mode = LATIN; Continue Latin entry. |

As can be seen, with the primary language, the characters proceed in the primary direction (left to right), and the cursor precedes the characters in the primary direction. The cursor, in effect, slides in the primary direction in advance of each character to be inserted.

In the secondary direction, the cursor once again precedes the characters in the primary direction. However, each time a character is inserted, those characters already displayed, and the cursor, slide one space over in the primary direction. The newly added character fills the space vacated by the character which had been inserted in the previous step.

With this arrangement, the relation of the video memory cell contents and the screen column contents (of the CRT display screen) is as follows:

| | |
|---|---|
| | 1 1 1 1 1 1 1 |
| Application memory cells: | 1 2 3 4 5 6 7 8 9 0 1 2 3 4 5 6 |
| | HE SAID ر ا ت ح م ل |
| | 1 1 1 1 1 1 1 |
| Screen columns: | 1 2 3 4 5 6 7 8 9 0 1 2 3 4 5 6 |
| | HE SAID ا ل م ح ت ا ر |

In this situation, screen operations such as cursor movement, replacement or deletion of characters, and scrolling will not have the expected effects. For example, what is in memory cell 15 is now in fact displayed on screen column 9. If the application does an absolute cursor addressing movement to column 15 to output a blank with the intention of erasing the last letter of the Arabic word, it will in fact position the cursor on the screen at column 15 and erase the first letter instead. Obviously, this will not give the expected results.

It is therefore necessary to ensure that the chronological order of the appearance of data (in the memory cells) corresponds with the geographical order (on the display screen). That is, the screen should be numbered as follows:

| | |
|---|---|
| | <slide> |
| | 1 1 1 1 1 1 1 |
| Screen columns: | 1 2 3 4 5 6 7 8 5 4 3 2 1 0 9 6 |
| | HE SAID ا ل م ح ت ا ر |

In this way, the application requesting the cursor to be at column 15 will effectively position the cursor on the desired character. As will be seen, in accordance with the method and apparatus herein, this effect will be achieved.

The CRT controller is an electronic subsystem which converts the character (i.e., display) codes contained in the video memory, in specific, ordered locations, into a set of control signals which will make the CRT display screen display these characters.

Figure 2:
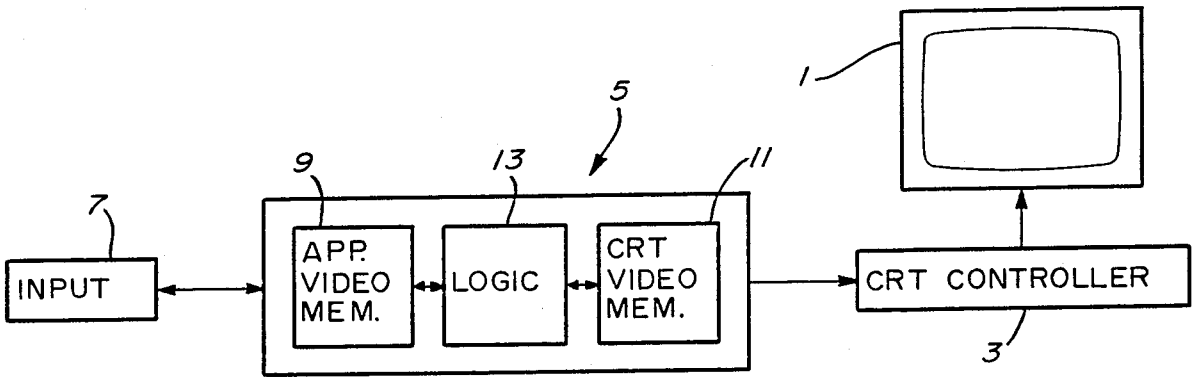
FIG. 2 illustrates a system in accordance with the invention.
Figure 3:
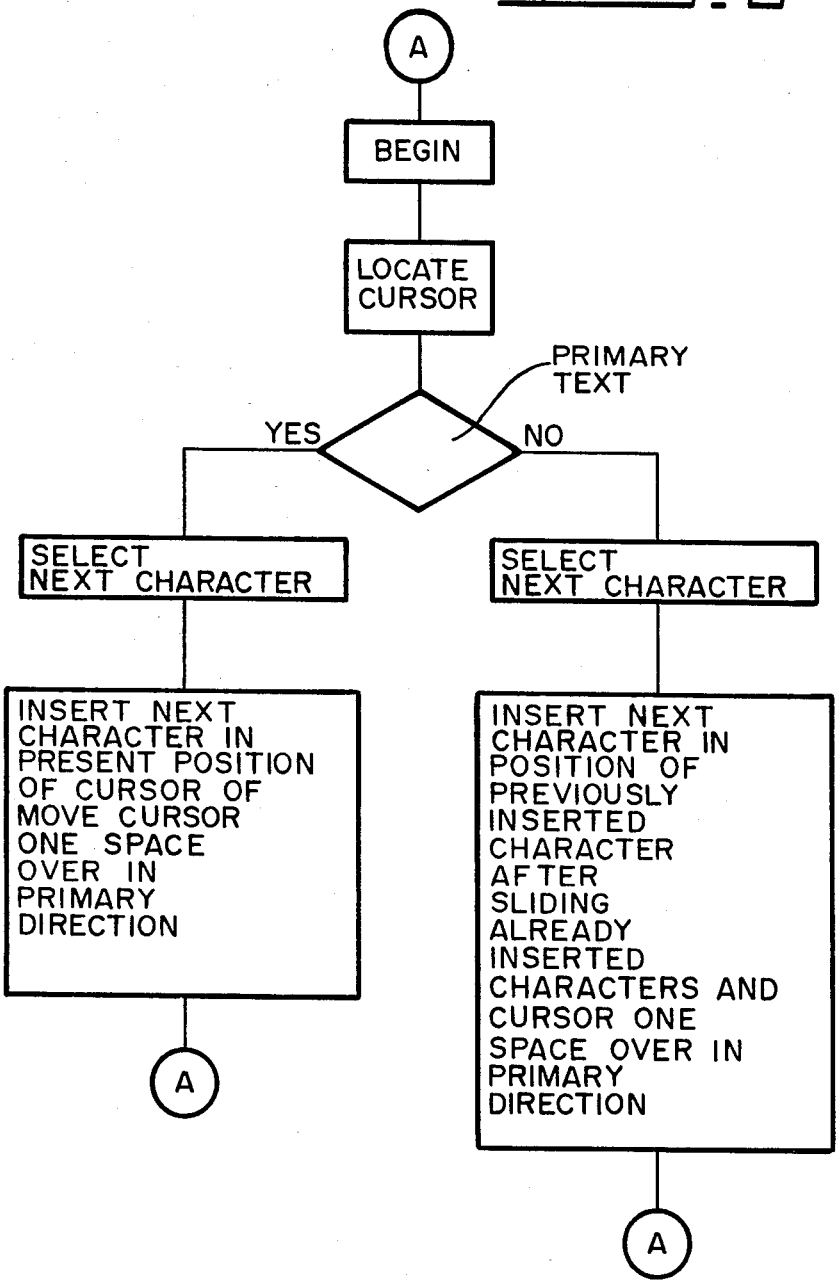
FIG. 3 is a flow chart of the logic means interconnecting the application video memory and the CRT video memory.

In order to effect the advantages as above described, a system as illustrated in FIG. 2 is used in accordance with the invention. As can be seen, in the inventive system, the video memory 5 is split into an application video memory 9 and a CRT video memory 11. The memories 9 and 11 are interconnected by logic means 13. The logic means manipulate the text of the primary and secondary languages in accordance with the rules of these languages. The logic means is a processor, and a flow chart of the program for driving the processor is illustrated in FIG. 3. That is, the characters of the secondary language will slide one space as above described. In addition, the logic means will "renumber" the cells of the CRT memory so that, when the text of a secondary language is being processed, the numbering of the cells will proceed in the secondary direction. Thus, the contents of like numbered cells in the application and CRT video memories will be alike, although the chronological ordering of the numbering of the cells will not be the same.

The column lines of the CRT display screen will be "renumbered" to correspond with the numbering of the CRT memory. Thus, screen operations such as cursor movements, replacements or deletions of characters and scrolling will have the expected effect.

In addition, the apparatus and method is transparent to the operating systems application programs. The user and the programmer are not aware of what is going on. They merely enter the characters and notice that they appear in their correct order on the screen.

In order for the logic means to provide manipulations for the secondary language, it must first receive a signal that it is now in a secondary language mode. This signal could be provided by, for example, a separate key on the key board. When the signal for the secondary text is given, then the logic means will proceed from the right-hand side of the flow chart. When the signal is removed, and at all other times, the logic means will proceed down the left-hand side of the flow chart.

Although a particular embodiment has been described, this was for the purpose of illustrating but not limiting, the invention. Various modifications, which will come readily to the mind of one skilled in the art, are within the scope of the invention as defined in the appended claims.

We claim:

1. In a CRT display system, wherein said system comprises:

a CRT display screen;

a CRT controller connected to said CRT display screen for controlling the display on said CRT display screen;

video memory means connected to said CRT controller; and means for applying character codes to said video memory means;

whereby, said CRT controller converts the character codes in said video memory means to control signals for displaying the characters of the character codes in an ordered relationship on said CRT display screen;

the improvement for permitting display of a primary text of a primary language, whose characters proceed in a primary direction, and a secondary text of a secondary language, whose characters proceed in a different, secondary direction, in a manner that applies to unmodified, existing software programs logic and data;

said improvement comprising:

said video memory means being divided between an application video memory, connected to said means for applying character codes, and a CRT video memory, connected to said CRT controller; and said application video memory being connected to said means for applying character codes such that the character codes are applied in the manner used by said unmodified, existing software programs logic and data;

logic means connecting said application video memory to said CRT video memory; and said logic means using said application video memory to control said CRT video memory for displaying said primary and secondary texts in accordance with the rules of said primary and secondary languages, in a manner that is transparent to said means for applying character codes;

whereby said improvement results in a transparent process by which said means for applying character codes can then be used without modification, as part of said unmodified, existing software programs logic and data, to display primary and secondary texts of primary and secondary languages whose characters proceed in different directions.

2. The improvement as defined in claim 1 wherein, when said primary language is being processed, the characters of the primary text proceed in said primary direction and a cursor precedes the last character in said primary direction; and when said secondary language is being processed, when a next character is inserted, the already displayed characters and the cursor slide one space in said primary direction and the next character takes up the space vacated by the character previously inserted, in a manner that is transparent to said means for applying character codes.

3. The improvement as defined in claim 2 wherein the characters are inserted in the application video memory in a chronological order; and the characters are inserted in the CRT video memory in geographical order corresponding to their appearance on the CRT display screen;

said improvement being transparent for said means for applying character codes.

4. The improvement as defined in claim 3 and further including means for providing a signal that the secondary language is now being inserted.

5. A method for permitting display of a primary text of a primary language, whose characters proceed in a primary direction, and a secondary text of a secondary language, whose characters proceed in a different, secondary direction, on a display screen of a CRT display system which includes an application video memory and a CRT video memory connected by logic means which manipulates said primary and secondary texts in accordance with the rules of said primary and secondary languages, and a CRT controller connected to said CRT video memory for receiving data therefrom, and to said CRT display screen for driving said CRT display screen;

the steps of:

applying character codes of said text to said application video memory in the manner used by unmodified, existing software programs logic and data;

said logic means manipulating characters of said text whereby to provide data to the CRT controller such that;

characters of said primary language, when displayed on said CRT display screen, proceed in said primary direction and a cursor precedes the last displayed character in the primary direction; and when a next character of said secondary language is to be displayed, the already displayed characters of said secondary language slide one space in said primary direction and said cursor precedes said characters in said primary direction, and the next character occupies the space vacated by the previously inserted character, in a manner that is transparent to said means for applying character codes;

whereby there is provided a transparent process by which said means for applying character codes can then be used without modification, as part of said unmodified existing software programs logic and data, to display primary and secondary text of primary and secondary languages whose characters proceed to different directions.

6. A method as defined in claim 5 wherein the characters are inserted in the application video memory in chronological order by said means for applying character codes; and the character codes are inserted in the CRT video memory in geographical order corresponding to their appearance on the CRT display screen by said logic means in a manner that is transparent to said means for applying character codes.

7. A method as defined in claim 6 and further including the step of providing a signal, when the secondary language is to be inserted, to instruct the system that the secondary language is now being inserted.

* * * * *